US010227783B2

(12) United States Patent
Ruland et al.

(10) Patent No.: US 10,227,783 B2
(45) Date of Patent: Mar. 12, 2019

(54) RAISED FLOOR SYSTEM GROUNDING

(71) Applicant: Hubbell Incorporated, Shelton, CT (US)

(72) Inventors: Rodd R. Ruland, Amherst, NH (US); Jerry L. Heckman, New Hampton, NH (US)

(73) Assignee: Hubbell Incorporated, Shelton, CT (US)

( * ) Notice: Subject to any disclaimer, the term of this patent is extended or adjusted under 35 U.S.C. 154(b) by 770 days.

(21) Appl. No.: 14/548,517

(22) Filed: Nov. 20, 2014

(65) Prior Publication Data

US 2015/0074972 A1 Mar. 19, 2015

Related U.S. Application Data

(62) Division of application No. 12/317,319, filed on Dec. 22, 2008, now Pat. No. 8,938,918.

(51) Int. Cl.
*E04F 15/02* (2006.01)
*E04F 15/024* (2006.01)

(52) U.S. Cl.
CPC ... *E04F 15/02447* (2013.01); *Y10T 29/49826* (2015.01)

(58) Field of Classification Search
CPC ..... H02G 3/285; H02G 3/385; E04F 15/0247; E04F 15/02458; E04F 15/024; E04B 5/48
USPC ..... 52/126.1, 126.6, 220.1, 220.5, 263
See application file for complete search history.

(56) References Cited

U.S. PATENT DOCUMENTS

| | | | | | |
|---|---|---|---|---|---|
| 774,099 | A | * | 11/1904 | Narsh | 256/47 |
| 846,202 | A | * | 3/1907 | Harrah | 256/58 |
| 1,056,173 | A | * | 3/1913 | Higgin | 256/58 |
| 2,364,419 | A | * | 12/1944 | Barnes | 256/58 |
| 3,811,237 | A | * | 5/1974 | Bettinger | 52/126.6 |
| 4,142,638 | A | * | 3/1979 | Vargo | 211/187 |
| 4,630,417 | A | * | 12/1986 | Collier | 52/263 |
| 4,676,036 | A | * | 6/1987 | Bessert | 52/126.6 |
| 4,780,571 | A | * | 10/1988 | Huang | 174/484 |
| 4,863,390 | A | * | 9/1989 | Cera et al. | 439/100 |
| 4,893,441 | A | * | 1/1990 | Catalano et al. | 52/126.6 |
| 4,976,627 | A | * | 12/1990 | O'Loughlin | 439/100 |
| 5,049,700 | A | * | 9/1991 | Kobayashi et al. | 174/482 |
| 5,286,211 | A | * | 2/1994 | McIntosh | 439/100 |
| 5,389,737 | A | * | 2/1995 | Kobayashi et al. | 174/483 |
| 5,412,914 | A | | 5/1995 | Daw et al. | |
| 5,546,717 | A | | 8/1996 | Penczak et al. | |
| 5,548,932 | A | * | 8/1996 | Mead | 52/126.6 |
| 5,888,104 | A | * | 3/1999 | Mello et al. | 439/785 |
| 6,061,984 | A | * | 5/2000 | Rose | 52/220.1 |
| 6,427,400 | B1 | | 8/2002 | Greenblatt | |
| 6,449,912 | B2 | * | 9/2002 | Jette | 52/220.1 |
| 6,504,098 | B2 | | 1/2003 | Seamans | |
| 6,637,161 | B1 | | 10/2003 | Buchalter et al. | |

(Continued)

*Primary Examiner* — Joshua K Ihezie
(74) *Attorney, Agent, or Firm* — Harrington & Smith

(57) ABSTRACT

A raised floor pedestal including a base configured to sit on a floor; and a post extending up from the base. The post includes a metal member having a general tube shape. A top of the post forms a support surface configured to support a portion of a raised floor system thereon. A side of the post includes an integrally formed ground conductor connector piece extending therefrom. The ground conductor connector piece is configured to have an electrical ground conductor connected directly thereto.

12 Claims, 5 Drawing Sheets

(56) References Cited

U.S. PATENT DOCUMENTS

| | | | | |
|---|---|---|---|---|
| 6,637,165 | B2 * | 10/2003 | Jette | 52/220.1 |
| 6,710,244 | B1 | 3/2004 | Pferschy | |
| 7,373,759 | B1 * | 5/2008 | Simmons | 52/220.5 |
| 7,476,801 | B1 * | 1/2009 | Davis et al. | 174/481 |
| 7,586,036 | B2 * | 9/2009 | Davis et al. | 174/40 CC |
| 7,650,725 | B2 * | 1/2010 | Mead | 52/263 |
| 7,650,726 | B2 * | 1/2010 | Jakob-Bamberg et al. | 52/263 |
| 7,708,234 | B2 * | 5/2010 | Kossak | 248/49 |
| 7,794,243 | B1 * | 9/2010 | Rzasa et al. | 439/100 |
| 2001/0011441 | A1 | 8/2001 | Jette | |
| 2001/0034987 | A1 | 11/2001 | Cooper et al. | |
| 2002/0003194 | A1 * | 1/2002 | Simmons | 248/49 |
| 2002/0014045 | A1 * | 2/2002 | Jette | 52/220.1 |
| 2002/0184843 | A1 * | 12/2002 | Jette | 52/220.1 |
| 2003/0177723 | A1 * | 9/2003 | Jakob-Bamberg et al. | 52/263 |
| 2005/0124190 | A1 * | 6/2005 | Mead | 439/92 |
| 2005/0235589 | A1 * | 10/2005 | Jakob-Bamberg et al. | 52/263 |
| 2009/0008516 | A1 * | 1/2009 | Davis et al. | 248/74.1 |
| 2009/0090073 | A1 * | 4/2009 | Bravo et al. | 52/220.1 |
| 2009/0090549 | A1 * | 4/2009 | Betz | 174/486 |
| 2010/0221934 | A1 * | 9/2010 | Robicheau et al. | 439/100 |
| 2010/0221935 | A1 | 9/2010 | Rzasa et al. | |
| 2010/0299909 | A1 * | 12/2010 | Rzasa et al. | 29/525.11 |

* cited by examiner

RAISED FLOOR SYSTEM GROUNDING

CROSS REFERENCE TO RELATED APPLICATION

This is a divisional patent application of copending application Ser. No. 12/317,319 filed Dec. 22, 2008 which is hereby incorporated by reference in its entirety.

BACKGROUND OF THE INVENTION

Field of the Invention

The invention relates to a raised floor system and, more particularly, to grounding in a raised floor system.

Brief Description of Prior Developments

It is known in raised floor structures, used in a building having numerous computer or telephone or electrical devices, to provide a grounding network. The understructure of a raised floor system includes multiple pedestals and perhaps stringers and seismic supports. Floor panels are located on top of the pedestals. The panels can include, for example, aluminum panels, or steel panels such as hollow, perforated, grated, concrete filled, wood filled and calcium chloride filled.

A grounding network of a raised floor system can comprise ground conductors or cables arranged in a parallel grid or a perpendicular grid. A ground connector is used to connect the cable to the pedestal of the raised floor system. U.S. Pat. No. 5,286,211 discloses a ground connector where conductors can be clamped directly against a post in two orthogonal orientations. There is a desire for a faster and less expensive way to connect a ground conductor to a pedestal of a raised floor system.

SUMMARY

The following summary is merely intended to be exemplary. The summary is not intended to limit the scope of the claimed invention.

In accordance with one aspect of the invention, a raised floor pedestal is provided including a base configured to sit on a floor and may not extend into soil or rock; and a post extending up from the base. The post includes a metal member having a general tube shape. A top of the post forms a support surface configured to support a portion of a raised floor system thereon. A side of the post includes an integrally formed ground conductor connector piece extending therefrom. The ground conductor connector piece is configured to have an electrical ground conductor connected directly thereto.

In accordance with another aspect of the invention, a raised floor system is provided comprising a plurality of pedestals, floor panels supported on top of the pedestals, and an electrical ground conductor. Each of the pedestals comprise an electrical ground conductor connector. The connector comprises an integrally formed piece extending from a side of the pedestal. The electrical ground conductor is connected directly to the connectors of the pedestals.

In accordance with another aspect of the invention, a method is provided comprising providing a tube comprised of a metal member; stamping the metal member to form a clip, wherein the clip extends from a side of the tube; and connecting the tube to a base. The base is configured to support the tube in a substantially vertical orientation when the base is located on a floor. The tube and base are configured to support raised floor panels above the floor. The tube is configured to electrically connect to a ground conductor at the clip to support the ground conductor above the floor and electrically connect the tube to the ground conductor.

In accordance with another aspect of the invention, a method is provided comprising placing a pedestal on a floor; connecting a ground conductor directly to the pedestal, wherein the pedestal comprises a post with an integrally formed clip on a side of the post, wherein the ground conductor is directly attached to the clip; and positioning raised floor panels on top of the pedestal.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENTS

Figure 1:
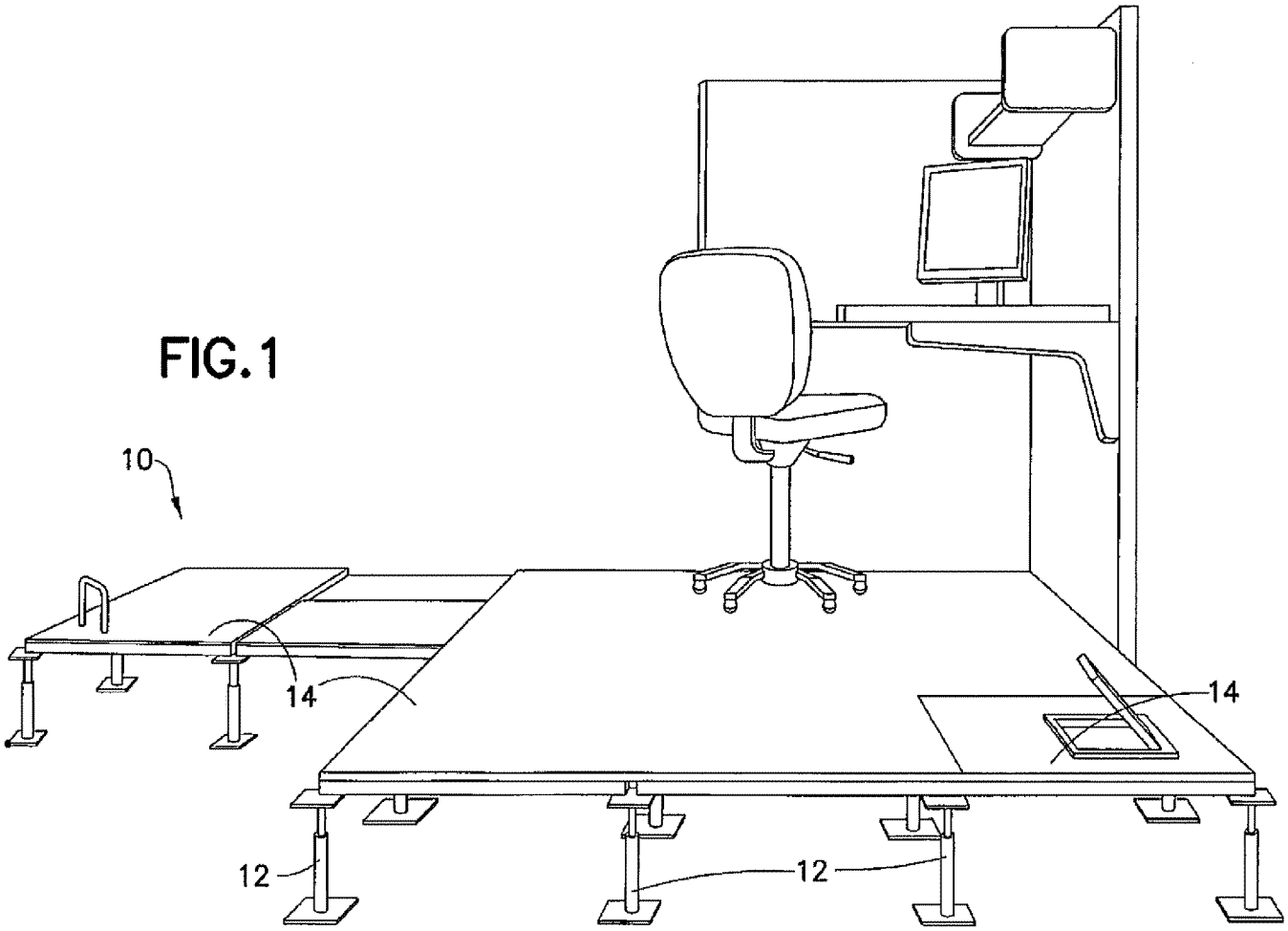
FIG. 1 is a perspective view of a raised floor system comprising features of the invention.

Referring to FIG. 1, there is shown a view of a raised floor system 10 incorporating features of the invention. Although the invention will be described with reference to the example embodiments shown in the drawings, it should be understood that the invention can be embodied in many alternate forms of embodiments. In addition, any suitable size, shape or type of elements or materials could be used.

Figure 2:
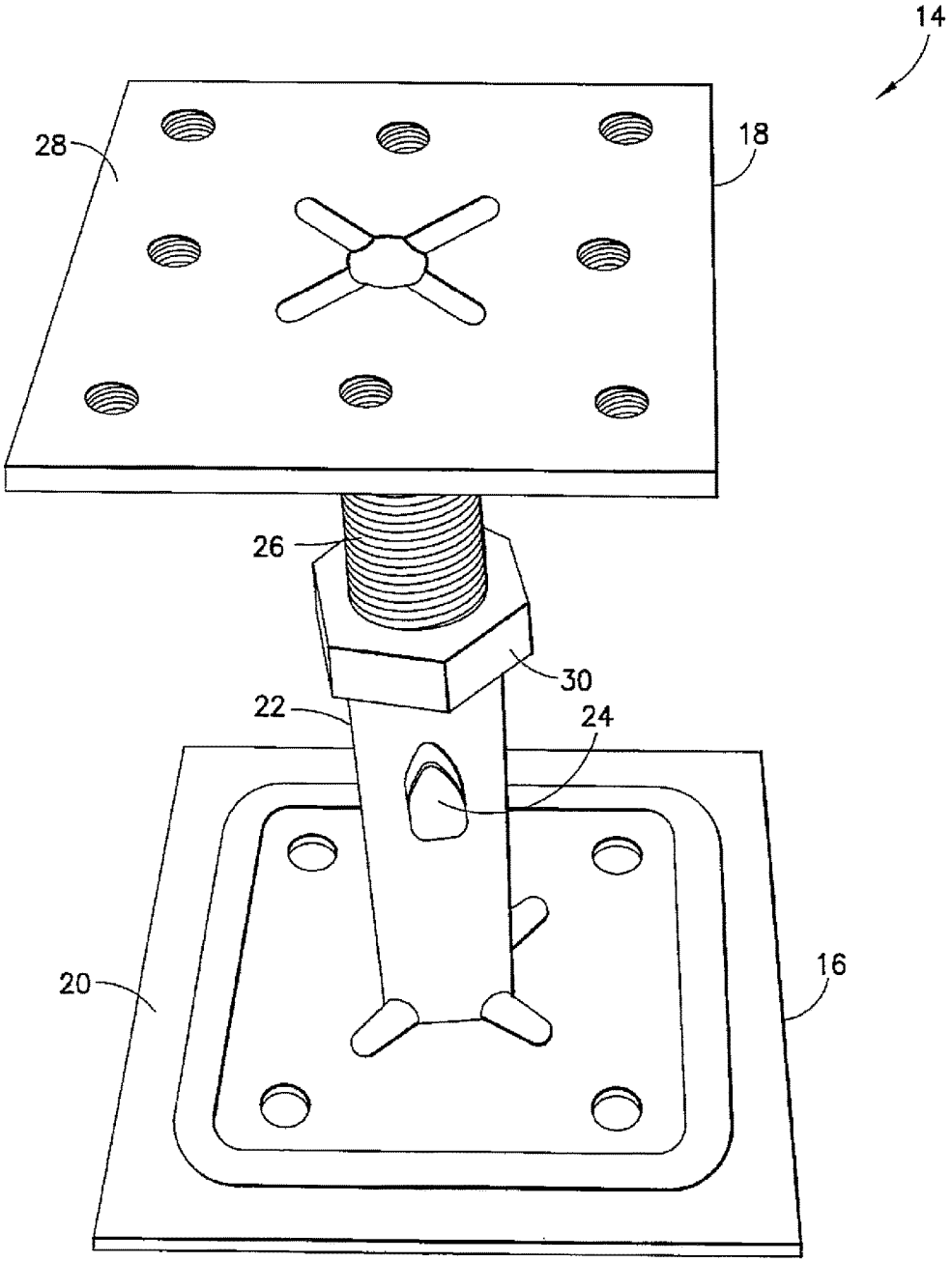
FIG. 2 is a perspective view of one of the pedestals shown in FIG. 1.

The system 10 generally comprises pedestals 12 and panels 14. The panels 14 are conventional panels of a raised floor system. Referring also to FIG. 2, one of the raised floor pedestals 12 is shown. The pedestal 12 generally comprises a first section 16 and a second section 18. The second section 18 is adjustably connected to the first section in this embodiment. However, in alternate embodiments the second section might not be movably connected to the first section. The first section 16 comprises a base 20 and a post 22. The base and post are preferably comprised of metal. In this embodiment the post 22 is stationarily attached to the base, such as by welding. However, in alternate embodiments the base and post could be integrally formed or connected in any other suitable method.

The base 20 is sized and shaped to sit or rest on a floor, such as a concrete floor of an office building for example. The base 20 has a general square or rectangular planar shape, but could have other shapes. In an alternate embodiment the base could be sized and shaped to connect to another member.

The post 22 extends upward from the base 20. The post 22 has a general tube shape. In the embodiment shown the tube shape is generally square in cross section, but could have alternative cross sectional shapes. An aperture extends into the top end of the post 22 into the central channel of the tube shape. The post 22 has ground conductor connector pieces 24 which will be further described below.

The second section 18 generally comprises a post 26 and a top support 28. The post 26 and top support 28 are conventional in this embodiment. The post 26 is a threaded post with threads on its exterior side. The top support 28 is connected to the top end of the post 26. The top side of the top support 28 is adapted to support the panels 14 thereon.

The second section 18 comprises an adjuster 30. The adjuster 30 is connected to the threads of the post 26. In this embodiment the adjuster 30 is a nut. The bottom side of the nut 30 rests on the top end of the post 22. In alternate embodiments any suitable type of height adjustment system between the first and second sections could be provided.

The bottom end of the post 26 extends into the center channel of the post 22 through the open top end of the post 22. With the nut 30 resting on the top support surface of the post 22, when the nut 30 is turned the post 26 can move up and down relative to the post 22. Thus, the height of the top support 28 relative to the base 20 can be adjusted.

Figure 3:
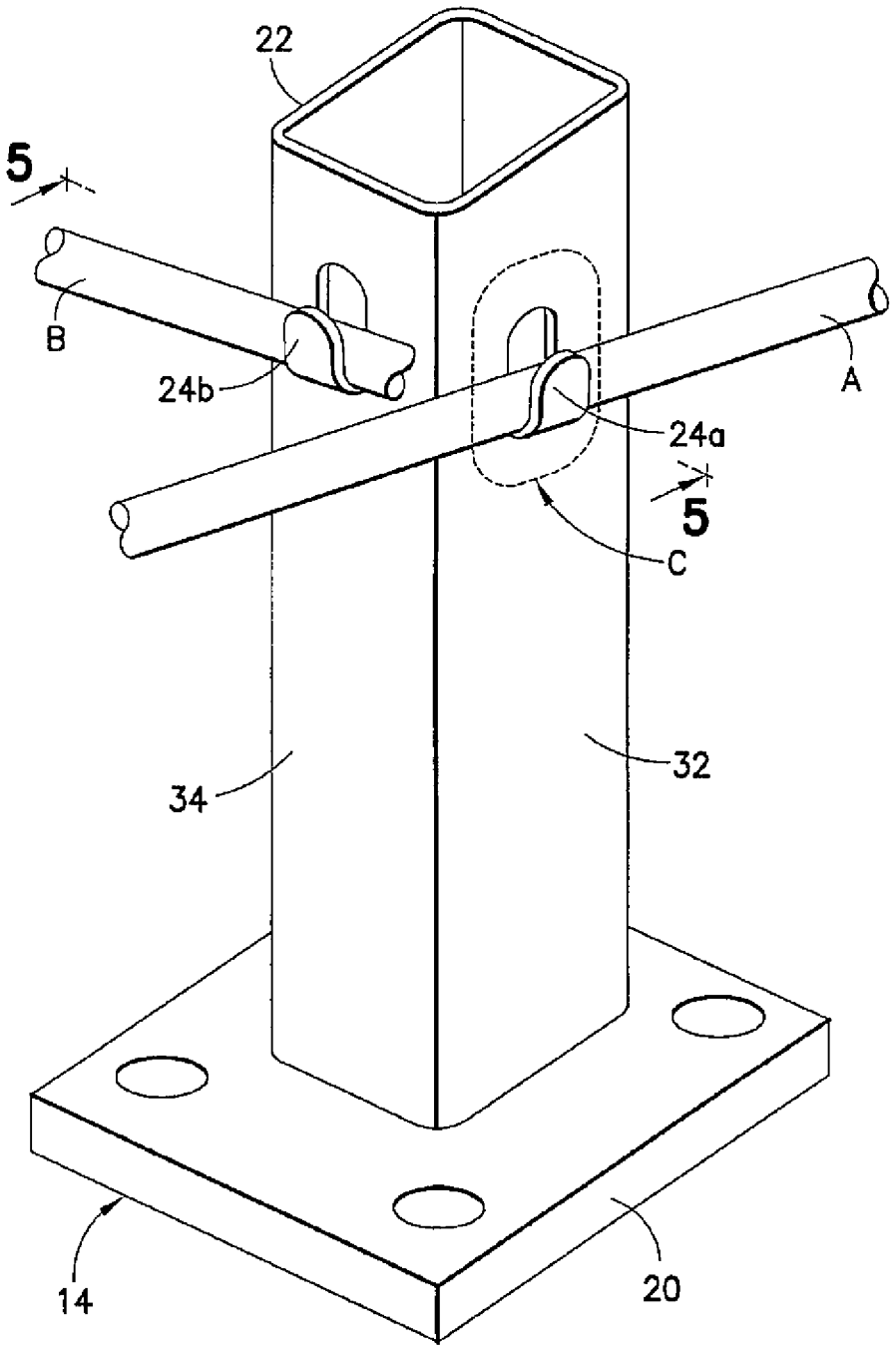
FIG. 3 is a perspective view of the first second of the pedestal shown in FIG. 2 showing two conductors attached.

Referring also to FIG. 3, the first section 16 is shown without the second section 18 merely for the sake of clarity. In this embodiment the post 22 has two of the ground conductor connector pieces 24. A first one of the pieces 24*a* is located on a first side 32. A second one of the pieces 24*b* is located on a second side 34. In an alternate embodiment more or less than two sides of the post could have the connector pieces 24. In additional a side might have more than one connector piece, and the pieces could have different sizes and shapes.

In the embodiment shown, the pieces 24*a*, 24*b* are located on the sides 32, 34 which are generally orthogonal to each other. However, in alternate embodiments, the connector pieces 24 could be located on only parallel sides or all four sides for example. In this embodiment the second connector piece 24*b* is located at a higher location (at least partially) on the height of the post 22 than the first connector piece 24*a*. However, in alternate embodiments the heights could be the same. The connector pieces 24 are sized and shaped to connect conductors, such as conductors A and B, to the post 22. This connection electrically grounds the posts (and thus the pedestals 14) and mechanically supports the ground conductors A, B at a predetermined height on the post 22.

Figure 4:
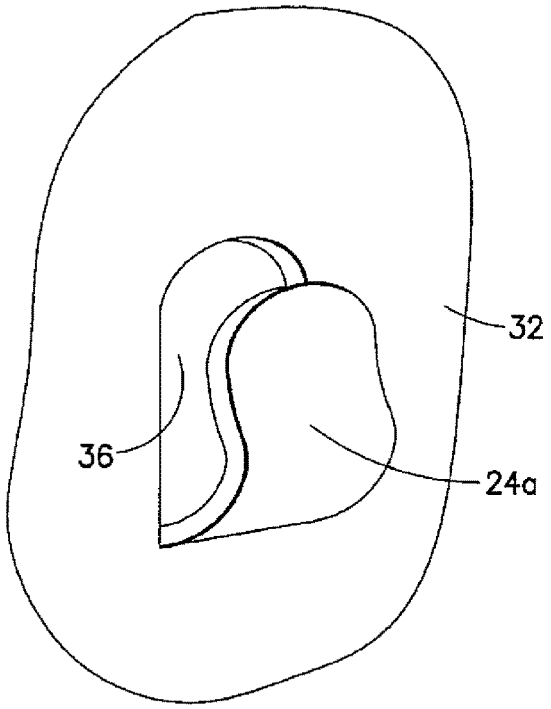
FIG. 4 is an enlarged partial view of one of the connector clips shown in FIG. 3.

Referring also to FIG. 4 an enlarged view of area C of FIG. 3 is shown without showing the conductor A. The connector piece 24*a* in this embodiment is a spring clip. However, in an alternate embodiment the clip might not comprise a spring feature. The clip 24*a* is integrally formed with the post 22. More specifically, the side 32 is stamped to form the clip 24*a*. The stamping process forms a hole 36 in the side 32. The clip 24*a* extends outward and upward in a general cantilever fashion. The post 22 can be formed of sheet metal which is bent and welded together such that the clip 24*a* is relatively easy to stamp into the side 32 before or after the metal member is bent into the general tube shape. Alternatively, the post 22 might be extruded and the clip 24*a* stamped into the side 32 after the metal member is extruded into the general tube shape. In an alternate embodiment the connector piece 24*a* could be attached to the metal member of the post as a separate member, such as by welding for example. However, in the preferred embodiment shown, the post and connector pieces are a one-piece member. In another alternate embodiment another member (not shown) might be attached to the connector piece to assist in connecting the ground conductor to the post 22.

Figure 5:
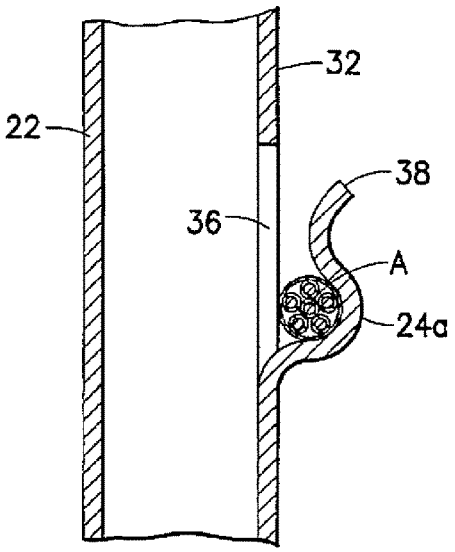
FIG. 5 is a cross sectional view taken along line 5-5 in FIG. 3.

Referring also to FIG. 5, the clip 24*a* is sized and shaped to allow a user to snap the conductor A into the space between the clip 24*a* and portions of the side at the hole 32. The top end of the clip 24*a* can resiliently deflect outward during this attaching method. After attachment, the clip 24*a* can hold the conductor A in a seat formed by the clip and thereby electrically connect the conductor A to the post 22. In this embodiment the clip 24*a* has a general serpentine shape with a tapered lead-in 38. However, in alternate embodiments any suitable shape could be provided. The second connector piece 24*b* is substantially identical to the first connector piece 24*a*, but smaller in size to accept the smaller size conductor B. However, the sizes could be the same and/or could be shaped to be conductor range taking. However, the spring clip feature of the clips 24 are already inherently conductor range taking.

The invention can be used to attach one or more conductors directly to the pedestal 14 without additional connectors. The conductors merely need to be connected with the piece(s) 24, such as by snapping the conductor(s) behind the clip(s) 24*a*, 24*b*. This is much faster and less expensive than having to use an additional connector, such as described in U.S. Pat. No. 5,286,211 for example. The present invention can also be used in a grounding network comprising ground conductors or cables arranged in a parallel grid and/or a perpendicular grid.

With the invention, a raised floor pedestal 14 can be provided comprising a base 20 configured to sit on a floor; and a post 22 extending up from the base, wherein the post comprises a metal member having a general tube shape, wherein a top of the post forms a support surface configured to support a portion 30 of a raised floor system thereon, wherein a side 32 of the post comprises an integrally formed ground conductor connector piece 24*a* extending therefrom, and wherein the ground conductor connector piece 24*a* is configured to have an electrical ground conductor A connected directly thereto.

The connector piece can comprise a clip 24*a* extending from the side of the post. The clip can have an upwardly extending cantilevered shape. The clip can be a spring clip configured to resiliently deflect when the electrical ground conductor is located between the clip and a portion of the post. The connector piece can comprise an outwardly stamped portion of the metal member. The connector piece can be sized and shaped to have the electrical ground conductor extend therethrough.

The raised floor pedestal can further comprise a threaded member 30 at the top of the post 22, and a movable top section 18 connected to the post 22, wherein the top section 18 comprises a top plate 18 and a threaded post 26 extending down from the top plate, wherein the threaded post 26 is connected to the threaded member 30 and extends into a central channel of the general tube shape 22.

The ground conductor connector piece 24*a* can form a first ground conductor connector piece and the side 32 of the post is a first side, and the post can comprise a second ground conductor connector piece 24*b* on a second side 34 of the post generally orthogonal to the first side. The first and second connector pieces 24 can be located, at least partially, at different heights on the post.

A raised floor system 10 can be provided comprising a plurality of pedestals 14, wherein each of the pedestals comprise an electrical ground conductor connector 24, wherein the connector comprises an integrally formed piece extending from a side of the pedestal; floor panels 14 supported on top of the pedestals; and an electrical ground conductor A connected directly to the connectors of the pedestals.

A method can be provided comprising providing a tube comprised of a metal member; stamping the metal member to form a clip, wherein the clip extends from a side of the tube; connecting the tube to a base, wherein the base is configured to support the tube in a substantially vertical orientation when the base is located on a floor, wherein the tube and base are configured to support raised floor panels above the floor, wherein the tube is configured to electrically connect to a ground conductor at the clip to support the ground conductor above the floor and electrically connect the tube to the ground conductor.

A method can be provided comprising placing a pedestal on a floor; connecting a ground conductor directly to the pedestal, wherein the pedestal comprises a post with an integrally formed clip on a side of the post, wherein the ground conductor is directly attached to the clip; and positioning raised floor panels on top of the pedestal.

Figure 8:
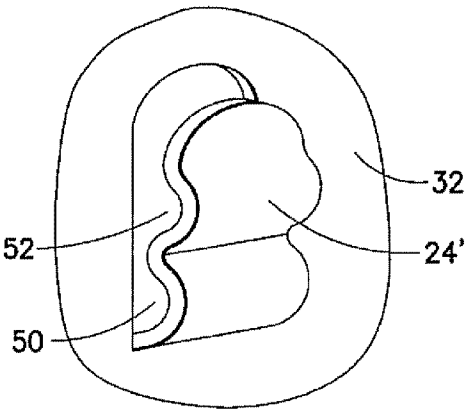
FIG. 8 is a partial perspective view of another alternate embodiment of the post.
Figure 7:
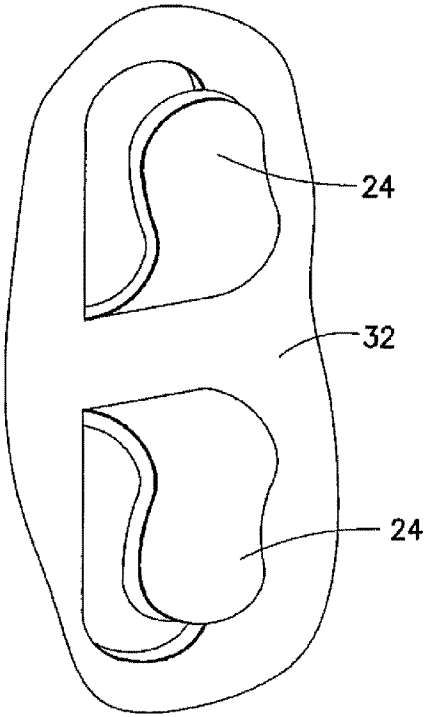
FIG. 7 is a partial perspective view of another alternate embodiment of the post.
Figure 6:
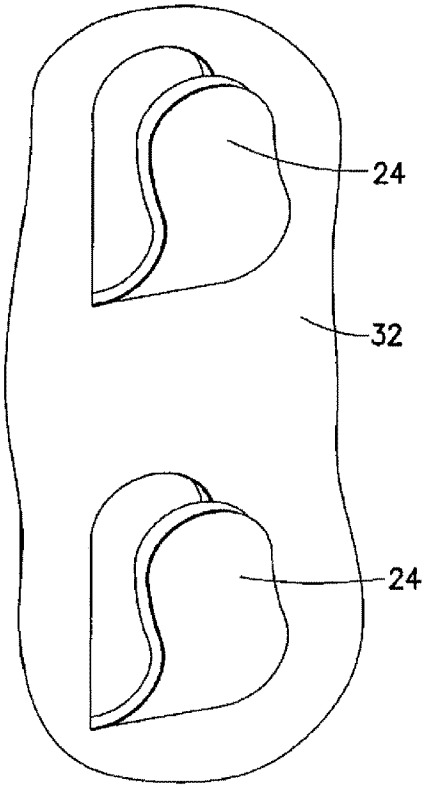
FIG. 6 is a partial perspective view of an alternate embodiment of the post.

FIG. 6 shows an alternate embodiment where the first side 32 has two of the clips 24. FIG. 7 shows an alternate embodiment where the first side 32 has two of the clips 24 orientated in different directions and having different sizes. FIG. 8 shows an alternate embodiment where the first side 32 has a single clip 24' with two receiving areas 50, 52 for having two conductors attached by the clip.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. A method comprising:

providing a tube comprised of a metal member;

stamping the metal member to form an electrical connector clip, wherein the electrical connector clip extends from a side of the tube, wherein the electrical connector clip is formed as a spring clip configured to resiliently deflect when an electrical ground conductor is located between the clip and the side of the tube;

connecting the tube to a base, wherein the base is configured to support the tube in a substantially vertical orientation when the base is located on a floor, wherein the tube and base are configured to support raised floor panels above the floor, wherein the tube is configured to electrically connect to the electrical ground conductor at the electrical connector clip to support the ground conductor above the floor and electrically connect the tube to the ground conductor; and forming a second electrical connector clip on a second different side of the tube.

2. A method as in claim 1 wherein the electrical connector clip is formed with an upwardly extending cantilevered shape.

3. A method as in claim 1 further comprising providing a threaded member at the top of the tube, and a movable top section connected to the tube, wherein the top section comprises a top plate and a threaded post extending down from the top plate, wherein the threaded post is connected to the threaded member and extends into a central channel of the tube.

4. A method as in claim 1 wherein the first and second electrical connector clips are formed, at least partially, at different heights on the tube.

5. A method comprising:

placing a pedestal on a floor;

connecting a ground conductor directly to the pedestal, wherein the pedestal comprises a post with an integrally formed electrical connector clip on a side of the post, wherein the ground conductor is directly attached to the electrical connector clip, where the connecting of the ground conductor directly to the pedestal comprises the electrical connector clip being a spring clip which resiliently deflects when the ground conductor is located between the electrical connector clip and the side of the post; and positioning raised floor panels on top of the pedestal, wherein the post comprises an integrally formed second electrical connector clip on a second side of the post, and the method further comprises connecting a second ground conductor directly to the pedestal at the second electrical connector clip.

6. A method as in claim 5 where the connecting of the ground conductor directly to the pedestal comprises downwardly inserting the ground conductor between the electrical connector clip and the post, where the electrical connector clip has an upwardly extending cantilevered shape.

7. A method as in claim 5 further comprising providing a threaded member at the top of the post, and a movable top section connected to the post, wherein the top section comprises a top plate and a threaded post extending down from the top plate, wherein the threaded post is connected to the threaded member and extends into a central channel of the post.

8. A method as in claim 5 wherein the electrical connector clips are located, at least partially, at different heights on the post.

9. A method comprising:

providing a tube;

forming an electrical connector clip on the tube, where the electrical connector clip is at a side of the tube, wherein the electrical connector clip is formed as a spring clip configured to resiliently deflect when a ground conductor is located between the electrical connector clip and the side of the tube;

connecting the tube to a base, wherein the base is configured to support the tube in a substantially vertical orientation when the base is located on a floor, wherein the tube and base are configured to support raised floor panels above the floor, wherein the tube and the electrical connector clip are configured to electrically connect to the ground conductor to thereby support the ground conductor above the floor and electrically connect the tube to the ground conductor; and forming a second electrical connector clip on a second different side of the tube.

10. A method as in claim 9 wherein the electrical connector clip is formed with an upwardly extending cantilevered shape.

11. A method as in claim 9 further comprising providing a threaded member at the top of the tube, and a movable top section connected to the tube, wherein the top section comprises a top plate and a threaded post extending down from the top plate, wherein the threaded post is connected to the threaded member and extends into a central channel of the tube.

12. A method as in claim 9 wherein the first and second electrical connector clips are formed, at least partially, at different heights on the tube.

* * * * *